US005697026A

United States Patent [19]

Matsumae et al.

[11] Patent Number: 5,697,026

[45] Date of Patent: Dec. 9, 1997

[54] DEVELOPING DEVICE HAVING THE LENGTHS OF TWO TONER TRANSPORTING ROLLERS AND AN IMAGE BEARING MEMBER IN SPECIFIC RELATIONSHIPS

[75] Inventors: Iwao Matsumae, Musashino; Kazuhiro Yuasa, Zama; Shuichi Endoh, Isehara; Yoshiaki Tanaka, Kawasaki; Hiroshi Hosokawa, Yokohama; Mugijiroh Uno, Isehara; Hiroshi Saitoh, Kanagawa; Eiji Takenaka, Isehara; Toshihiro Sugiyama, Atsugi; Tetsuo Yamanaka, Tokyo; Eisaku Murakami, Hiratsuka; Satoru Komatsubara, Atsugi, all of Japan

[73] Assignee: Ricoh Company, Ltd., Tokyo, Japan

[21] Appl. No.: 526,232

[22] Filed: Sep. 11, 1995

[30] Foreign Application Priority Data

Sep. 9, 1994 [JP] Japan ..... 6-240799

[51] Int. Cl.[6] ..... G03G 15/08

[52] U.S. Cl. ..... 399/267; 399/279

[58] Field of Search ..... 355/259, 245, 355/211, 251; 118/651, 657, 658

[56] References Cited

U.S. PATENT DOCUMENTS 3,667,428 6/1972 Smith ..... 355/259 X
5,264,900 11/1993 Momiyama et al. ..... 355/245 X
5,450,176 9/1995 Unemo et al. ..... 355/245
5,508,794 4/1996 Ikesue et al. ..... 355/245 X

FOREIGN PATENT DOCUMENTS 62-27771 2/1987 Japan ..... 355/259
1-107277 4/1989 Japan ..... 355/259

*Primary Examiner*—Arthur T. Grimley
*Assistant Examiner*—Sophia S. Chen
*Attorney, Agent, or Firm*—Oblon, Spivak, McClelland, Maier & Neustadt, P.C.

[57] ABSTRACT

An image forming apparatus including a developing device having various components with specific relationships between their lengths. There is an image bearing member such as a photoconductive drum or belt having a photosensitive layer. The photosensitive layer has a length A. A first toner transporting roller has two ends, the length between the two ends being defined as B. Additionally, there is a second toner transporting roller, disposed between and contacting both the image bearing member and the first toner transporting roller. The length of the second toner transporting roller being defined as C. The components of the image forming apparatus are constructed such the length of the second toner transporting roller is less than or equal to the lengths of both the first toner transporting roller and the photosensitive layer of the image bearing member. This means that the relationships A>C and B>C may exist. As an alternative, B is approximately equal to C with A being greater than both B and C. As a further alternative, A, B and C are each approximately equal to each other.

19 Claims, 4 Drawing Sheets

DEVELOPING DEVICE HAVING THE LENGTHS OF TWO TONER TRANSPORTING ROLLERS AND AN IMAGE BEARING MEMBER IN SPECIFIC RELATIONSHIPS

BACKGROUND OF THE INVENTION

1. Field of the Invention

This invention relates to a developing device that is used in an image forming apparatus such as a copying machine, plotter, laser printer or a facsimile machine. The invention further relates to the relationships between the lengths of two toner transporting rollers and an image bearing member such as a photoconductive drum or belt.

2. Discussion of the Background

A conventional two step type of developing device is as shown in FIG. 4. The developing device includes an image bearing member 1 (e.g. a photosensitive drum), a first toner transporting roller 3, and a second toner transporting roller 2 that is provided between the image bearing member 1 and the first toner transporting roller 3. The first toner transporting roller 3 is a roller having a magnetic field generating layer and toner is held on its surface. There is a doctor blade 4 in contact with the first toner transporting roller 3. A bottom portion 5*a* of a toner storing portion, which is part of a developing hopper 5, is formed upstream of the doctor blade 4 and extends under a lower side of the first toner transporting roller 3.

Toner is transferred from the hopper 5 using a toner supplying roller 20 to the first toner transporting roller 3. Toner T that is held on the first toner transporting roller 3 is controlled in thickness by the doctor blade 4, which charges the toner by friction. The second toner transporting roller 2 is an elastic roller having a dielectric layer on its surface and is in contact with the first toner transporting roller 3 and the image bearing member 1 at contacting areas, also referred to as a nip portion. The charged toner T is transferred from the first toner transporting roller 3 to the second toner transporting roller 2 by a bias voltage that is applied to the first toner transporting roller 3 by a voltage source/controller 24. The toner T which has been transferred from the first toner transporting roller 3 is transferred from the second toner transporting roller 2 to the image bearing member 1 which has a latent image formed thereon by a latent image forming device (not shown) such as laser writing device in order to reproduce the latent image.

As shown in FIG. 5, a length of the second toner transporting roller 2 is the same as that of the image bearing member 1 in a longitudinal direction, but a length of the first toner transporting roller 3 in a longitudinal direction is shorter than that of the second toner transporting roller 2. The second toner transporting roller 2 is between and in pressurized contact with both the image bearing member 1 and the first toner transporting roller 3, but the ends of the second transporting roller 2 do not contact the image bearing member 1 or the first toner transporting roller 3.

The second toner transporting roller 2 often gets thicker or swells (the diameter increases) at the ends because splashes at the ends occur when the roller 2 is formed. Further, a diameter of the ends of the roller 2 may be different from each other. Therefore, a distance between the axes of the first toner transporting roller 3 and the second toner transporting roller 2 may be from each other at the two ends. This causes pressure between the rollers at the ends to be different in the longitudinal direction. Accordingly, unevenness in density such as blur (dimness) due to a lack of toner a surplus of toner occurs. Since the length of the image bearing member 1 in the longitudinal direction is almost the same as that of the second toner transporting roller 2, charging characteristics are bad around boundaries of a photosensitive layer on the peripheral surfaces of both ends of the image bearing member 1 which allows toner to be improperly attracted to the surfaces.

SUMMARY OF THE INVENTION

The present invention has an object to overcome the above and other problems encountered in the aforementioned art. It is a further object of the present invention to provide a developing device capable of preventing unevenness in density.

It is another object of the invention to provide a developing device capable of preventing a non-image area from becoming dirty.

It is further object of the invention to make the pressure between an image bearing member and a second toner transporting roller uniform along a longitudinal direction.

It is yet another object of the invention to make the pressure between a first toner transporting roller and a second toner transporting roller uniform along the longitudinal direction.

These and other objects are achieved by an image forming apparatus including a developing device having various components with specific relationships between their lengths. There is an image bearing member such as a photoconductive drum or belt having a photosensitive layer. The photosensitive layer has a length A. A first toner transporting roller has two ends, the length between the two ends being defined as B. Additionally, there is a second toner transporting roller, disposed between and contacting both the image bearing member and the first toner transporting roller. The length of the second toner transporting roller being defined as C. The components of the image forming apparatus may be arranged such that A>C and B>C. As an alternative, B is approximately equal to C with A being greater than both B and C. As a further alternative, A, B and C are each approximately equal to each other.

The above relationships allow uniform distribution of toner, even when the second toner transporting roller has an increased diameter at the end portions. Further, the arrangement also prevents unnecessary toner from being transferred beyond the edges of the photosensitive layer of the image bearing member.

BRIEF DESCRIPTION OF THE DRAWINGS

Other objects and further features of the present invention will become apparent from the following detailed description when read in conjunction with the accompanying drawings, wherein.

DESCRIPTION OF THE PREFERRED EMBODIMENTS

Figure 1:
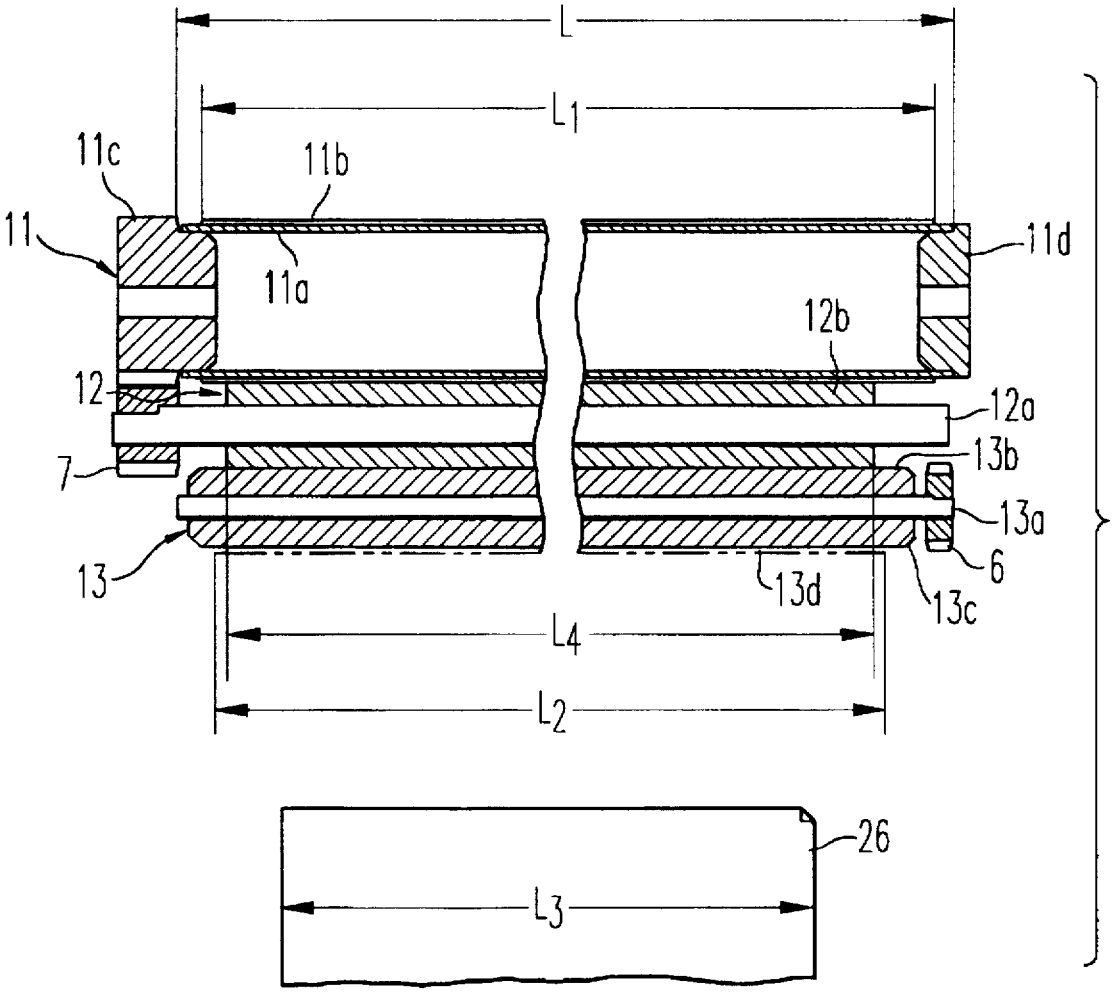
FIG. 1 illustrates the arrangement and components of a developing system of the first embodiment.
Figure 4:
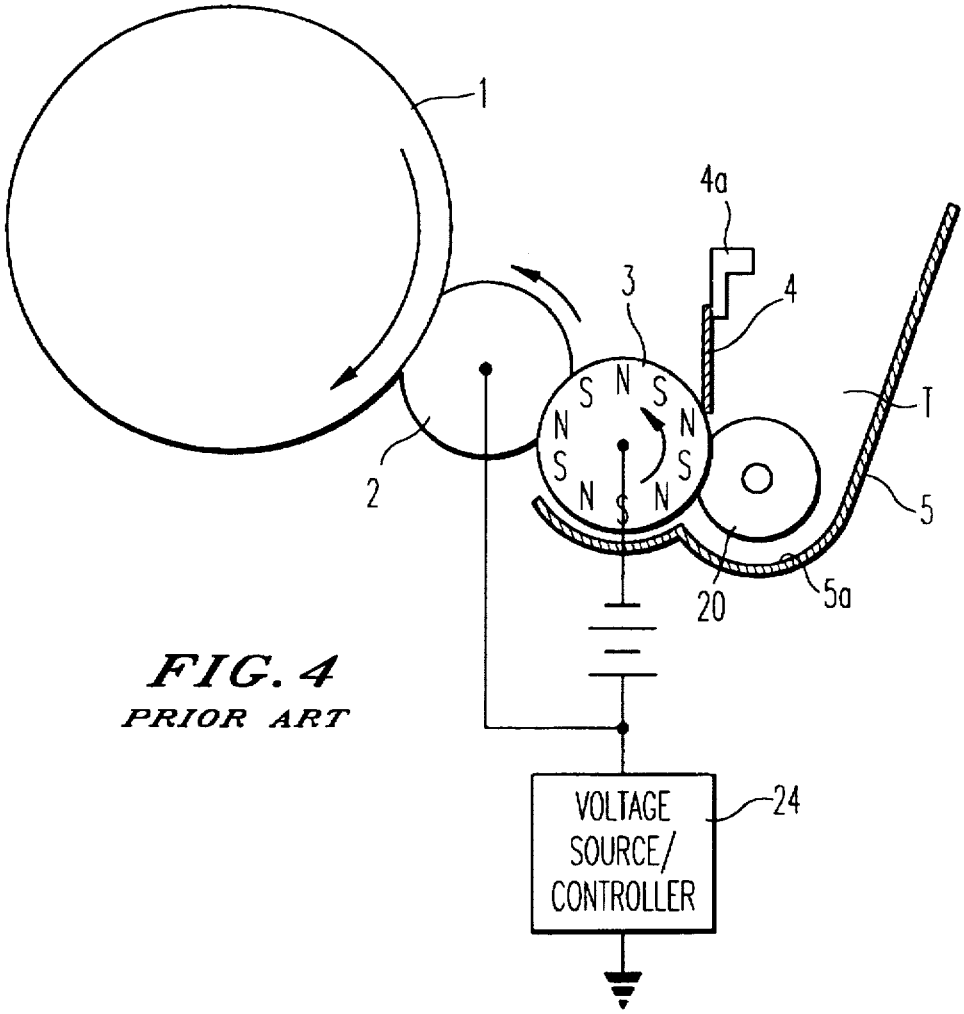
FIG. 4 PRIOR ART
FIG. 4 is a cross-sectional view of a two step type of a developing device according to the prior art.
Figure 5:
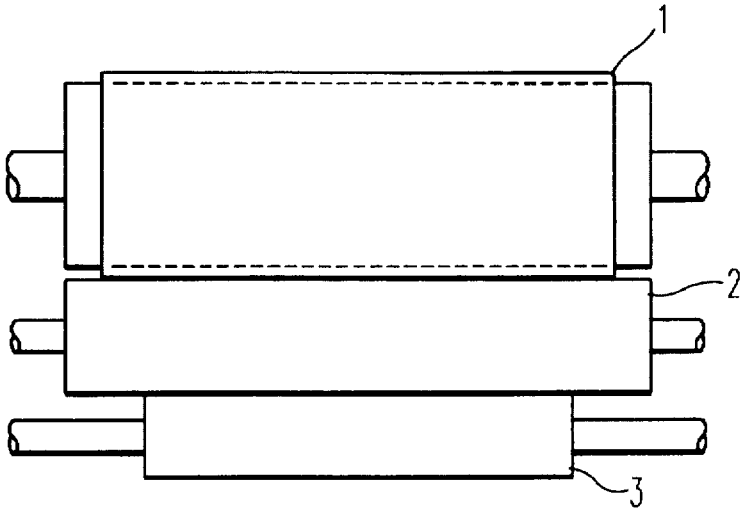
FIG. 5 PRIOR ART
FIG. 5 is a plane view of the two step type of the developing device according to the prior art.

Referring now to the drawings, wherein like reference numerals designate identical or corresponding parts throughout the several views, and more particularly to FIG. 1 thereof, there is illustrated a two step type of developing device according to the first embodiment of the present invention. This developing device may be incorporated into a system such as the system illustrated in FIG. 4. An image bearing member 11 is made up of a cylindrical member 11*a*, photoconductive layer 11*b* which is formed on a peripheral surface of the cylindrical member 11*a*, and flanges 11*c* and 11*d* which are inserted in the sides of the cylindrical member 11*a*. If desired, the image bearing member may be constructed as a belt or other suitable device. A second toner transporting roller 12 includes a core 12*a* and an electro-conductive or dielectric elastic layer 12*b* which is formed on a peripheral surface of the core 12*a*. A first toner transporting roller 13 is made up of a core 13*a* and a resin layer 13*b* which is formed on the core 13*a*. The roller 13 has corners or edges 13*c*. A magnetic field generating layer is formed on or in the resin layer 13*b*.

There is a gear 6 connected to a driving means (not shown) such as a motor having a clutch which is fixed to the shaft of the first toner transporting roller 13. A gear 7, attached to a shaft of the second toner transporting roller 12, is also connected to the driving means and meshes with a gear of the flange 11*c*.

The relationships between the lengths of the various rollers illustrated in FIG. 1 allow for an efficient, clean and proper transportation of toner from the first toner transporting roller 13 to the image bearing member 11. The lengths in FIG. 1 are defined below:

L: The length of cylindrical member 11*a* of the image bearing member 11.

L1: A length of an effective area of the photoconductive layer 11*b* on the image bearing member 11. The effective area of the photoconductive 11*b* is the portion on which images are (or can be) formed.

L2: The length of the first toner transporting roller 13 on which it is possible to form a thin layer of toner 13*d*. The thin layer of toner is the toner required for the duplication or printing process and has a desired thickness and density. While some toner may be on the roller 13 outside of the length L2, this toner is not used during the duplication or printing process.

L3: A width of the widest sheet of paper 26 that is used with the image forming apparatus.

L4: The length of the first toner transporting roller 13 which contacts the second toner transporting roller 12. This length, as seen in FIG. 1, also corresponds to a length of the second toner transporting roller 12.

The ends of the first and second toner transport rollers 13 and 12 may have tapered or rounded ends which may not properly transport toner. Therefore, the lengths of the first and second toner transport rollers are lengths of the rollers which are capable of properly and uniformly transporting toner. These lengths are lengths between the ends of the rollers.

The various lengths illustrated in FIG. 1 have the following relationships:

$$L>L1>L2>L4>L3 \quad (1)$$

The second toner transporting roller with the dielectric elastic layer 12*b* has its entire length (length between the ends which properly transports toner in a desired manner) in pressured contact between the photoconductive layer 11*b* of the image bearing member 11 and the first toner transporting roller 13. Accordingly, even if a diameter of the roller 12 is larger at the ends when an elastic layer 12*b*, such as an elastic rubber is formed, or when the ends are cut by a blade during the their manufacturing, it is possible to sufficiently compress the end portions of the second toner transporting roller 12. This is because the ends of the roller 12 do not extend past the ends of the roller 13 or the ends of the image bearing member 11.

Further, the first toner transporting roller 13 may be formed with an elastic layer which will further make it possible to get uniform pressure along the nip portion (the contact portion between rollers 12 and 13) along the entire contact portion between the rollers 12 and 13. Alteratively, the roller 12 may be the only roller with elastic characteristics.

As there is uniform pressure along the nip portions of the above-described rollers, it is possible to supply a suitable or desirable quantity of toner (single component type having a high resistance to the photoconductive layer 11*b*) preventing unevenness in toner density which is ultimately transferred to the image bearing member 11.

Since the length L4 of the second toner transporting roller 12 (the usable length for transporting toner between the ends) is shorter than the length L1, the length of the effective area of the photoconductive layer 11*b*, it is possible to prevent an instable charging of the toner from occurring immediately inside the boundary areas of the photoconductive layer 11*b* or around areas outside of the layer 11*b*, thus preventing the attachment of useless toner at and around the edges of the effective portion of the photoconductive layer. Since the length L4, the length of the second toner transporting roller 12 which contacts the first toner transporting roller 13 (which may also be the length of the roller 12), is shorter than a length L2 of an area on which it is possible to form a thin layer of toner, any instable toner on the first toner transporting roller 13 which is outside of the length L2 (which will also be outside of the length L4), will not be transferred onto the second toner transporting roller 12. Therefore, it is possible to prevent instable toner from attaching to the ends of the photoconductive layer 11*b* of the image bearing member 11 and extraneous toner will not form on the non-image area of the image bearing member thus preventing the ends of the image bearing member 11 from becoming dirty with toner.

The arrangement of the lengths illustrated in FIG. 1 allow a uniform toner layer to be transferred from the toner transporting roller 12 to the image bearing member 11. Because the paper 26 has a width L3 which is narrower than each of L4, L2, and L1, it is possible to form a stable toner layer on the photoconductive layer 11*b* which will ultimately be transferred to the largest width of paper that will be used with the apparatus. The above-described arrangement of FIG. 1 prevents unevenness in toner density and prevents blur (dimness) or running of toner. Additionally, unnecessary toner is not transferred to the non-usable ends of the image bearing member 11 and prevents possible waste and a scattering of toner.

Figure 2:
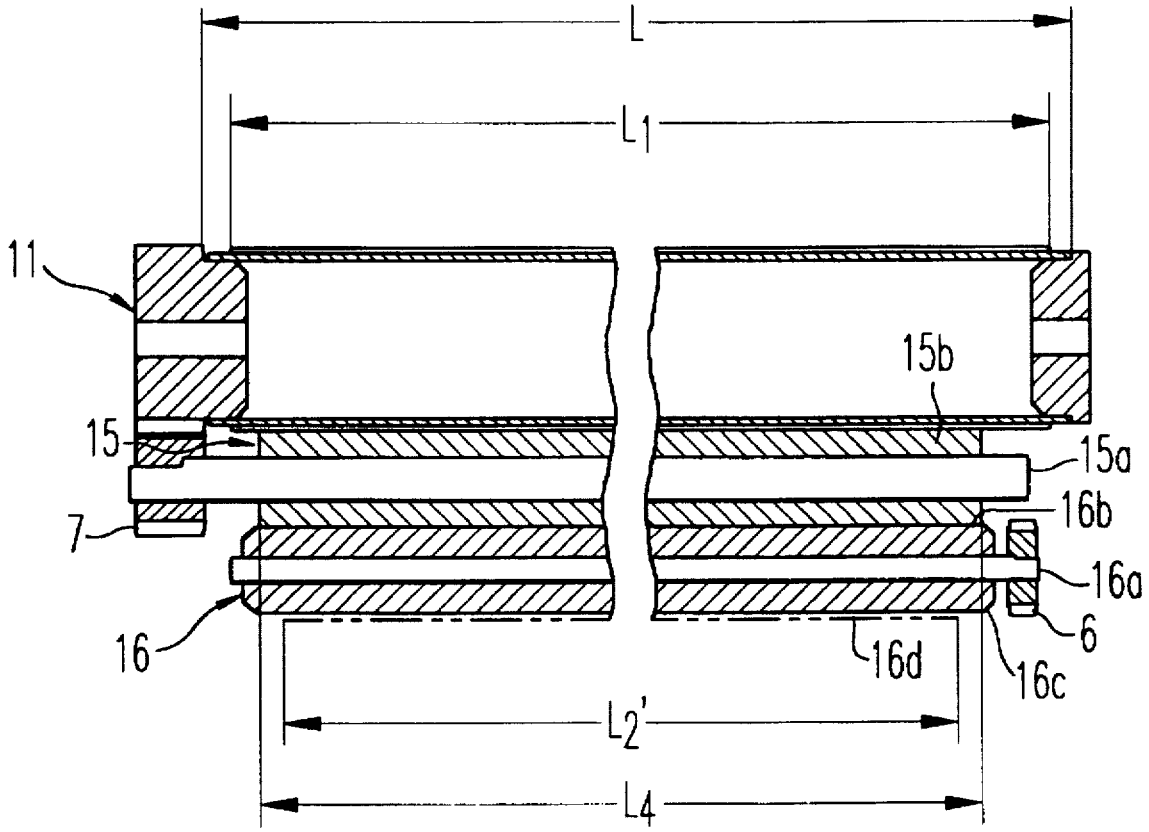
FIG. 2 illustrates the second embodiment according to the present invention.

FIG. 2 illustrates a two-step type of developing device according to the second embodiment of the invention. The image bearing member 11 is the same as the image bearing member 11 in FIG. 1. The second toner transporting roller 15 has a similar construction as the second toner transporting roller 12 illustrated in FIG. 1. The second toner transporting roller 15 is made of a core 15*a* and an electro-conductive or dielectric elastic layer 15*b* which is formed on a surface of the core 15*a*. A first toner transporting roller 16 includes a core 16*a* and a resin layer 16*b* on the surface of the core 16*a*. In the resin layer 16*b* is provided a magnetic field generating layer.

A length of the second toner transporting roller which is between any taper or rounded ends, should they exist, and the length of the first toner transporting roller 16 between the tapered edges thereof are approximately the same. The length of the first and second toner transporting rollers 16 and 15 is shorter than the length L1 of the effective area of the photosensitive layer 11*b*. This makes it possible to sufficiently compress enlargements or splashes at the ends of the second toner transporting roller 15 and allows sufficient and uniform contact pressure between the first and second toner transporting roller 16 and 15 and between the second toner transporting roller 15 and the image bearing member 11.

In this embodiment, as the corners or edges 16*c* of the ends of the first toner transporting roller 16 are planed off or rounded, no collapse around the border between the corners or edges in the portion inside of the corners or tapered edges occurs. Further, cracks and scratches on the second toner transporting roller 15 do not occur or have their frequency reduced.

In FIG. 2, it is seen that the length L2' which is the length at which it is possible to properly form a thin toner layer 16*d* on the roller 16 is smaller than L4, which is different from the length relationships illustrated in FIG. 1. The relationships between the lengths illustrated in FIG. 2 are as follows:

$$L>L1>L4>L2' \quad (2)$$

If desired, the length of the paper L3 is less than any length illustrated in FIG. 2 and is therefore less than the length L2'.

Since the length L4, the length of the second toner transporting roller 15 (to be more precise, the length within any tapered edges of the second toner transporting roller 15, if they exist) is shorter than the length L1 of the effective area of the photosensitive layer 11*b*, it is possible to prevent instable charging from occurring immediately inside boundary areas of the photoconductive layer 11*b* or outside of the boundary areas of the photoconductive layer 11*b*, thus preventing the attachment and possible waste of useless toner.

In the second embodiment, it is possible to uniformly transfer toner from the first toner transporting roller 16 to the second toner transporting roller 15 by making the contact pressure between the first toner transporting roller 16 and the second toner transporting roller 15 uniform. It is also possible to uniformly transfer toner from the roller 15 onto the image bearing member 11 by making the contact pressure between the roller 12 and the image bearing member 11 uniform. This makes it possible to prevent unevenness in toner density and reduces a blur (dimness) or running of the toner. It is also possible to prevent toner from scattering by preventing toner from transferring to the unused ends of the photoconductive layer.

Figure 3:
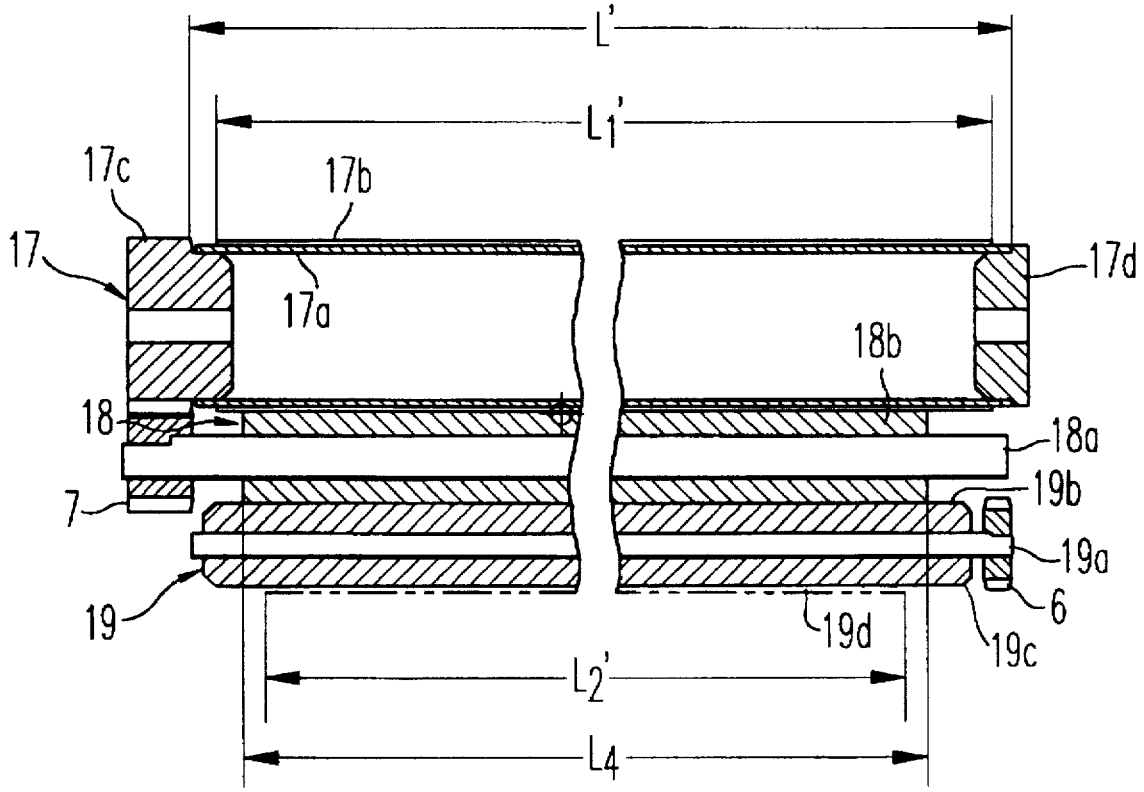
FIG. 3 illustrates the third embodiment according to the present invention.

FIG. 3 illustrates a two-step developing device according to the third embodiment of the invention. In FIG. 3, an image bearing member 17 is made of a cylindrical member 17*a*, a photoconductive layer 17*b* which is formed on a peripheral surface of the cylindrical member 17*a*, and flanges 17*c* and 17*d*. The length of the cylindrical member 17*a* is represented by L' and the length of the effective portion of the photoconductive layer 17*b* is represented by L1'. A second toner transporting roller 18 includes a core 18*a* and an electroconductive or dielectric elastic layer 18*b* which is formed on the peripheral surface of the core 18*a*. A first toner transporting roller 19 is made up of a core 19*a* and a resin layer 19*b* which is formed on the core 19*a*. A magnetic field generating layer is formed in or on the resin layer 19*b*. The corners are represented by 19*c* and 19*d* is the portion where it is possible to form a thin toner layer on the first toner transporting roller 19 and has the length L2'. L4 is the length of the first and second toner transporting rollers (actually the length between tapered edges, if any), of the nip portion between the first and second toner transporting rollers.

In FIG. 3, the following relationship between the lengths exists:

$$L>L1'\approx L4>L2' \quad (3)$$

If desired, L2 is greater than the width of the largest page usable with the machine L3. The length L4 of the first and second toner transporting rollers between tapered edges of the rollers, if any, is approximately equal to a length L1' of the effective area of the photoconductive layer 11*b*. Therefore, it is possible to sufficiently compress expanded portions or splashes in the second toner transporting roller. this allows uniform and sufficient pressure along the second toner transporting roller.

Both ends of the second toner transporting roller 18 are located at the boundary of the photoconductive layer 17*b* but toner does not attach immediately inside or outside of the boundary of the photoconductive layer 17*b* because an area where it is possible to make a thin toner layer having a width L2' is smaller than L1'.

According to the third embodiment, in addition to the advantages achieved by the first embodiment, because the photoconductive layer 17*b* having a length L1' is shorter than the length L1 of the first embodiment illustrated in FIG. 1, it is possible to make the thin toner layer which forms on the length L2' shorter and also possible to reduce the size of the developing device. Further, the smaller length of the photoconductive surface 17*b* reduces the amount of photosensitive material or paint which needs to be applied to the image bearing member 17, thus reducing manufacturing costs.

In this embodiment, lengths are described as being approximately or substantially equal. Accordingly, the lengths may be within 5%, 2½%, 1%, or any percentage between 5% and 0% of each other. However, if desired the lengths may deviate more from each other such as greater than 5% or greater than 10%.

Obviously, numerous modifications and variations of the present invention are possible in light of the above teachings. It is therefore to be understood that within the scope of the appended claims, the invention may be practiced otherwise than as specifically described herein.

What is claimed as new and is desired to be secured by Letters Patent of the United States is:

1. An image forming apparatus, comprising:

an image bearing member having a photosensitive layer, the photosensitive layer having a length A;

a first toner transporting means having two ends, a length between the two ends of the first toner transporting means being B; and a second toner transporting means, disposed between and contacting the image bearing member and the first toner transporting means, a length between the two ends of the second toner transporting means being C, wherein A>C and B>C.

2. An image forming apparatus according to claim 1, wherein:

said first toner transporting means and said second toner transporting means contact each other along a length D;

said second toner transporting means includes a length E on which a thin toner layer is formed; and

D>E.

3. An image forming apparatus according to claim 2, wherein:

C=D.

4. An image forming apparatus according to claim 1, wherein:

said first toner transporting means and said second toner transporting means contact each other along a length D;

a largest width of paper used in the image forming apparatus is F; and

D>F.

5. An image forming apparatus according to claim 1, wherein the image bearing member is a photoconductive drum.

6. An image forming apparatus according to claim 1, wherein the first and second toner transporting means are substantially cylindrical rollers.

7. An image forming apparatus, comprising:

an image bearing member having a photosensitive layer, the photosensitive layer having a length A;

a first toner transporting means having two tapered ends, a length between the two tapered ends of the first toner transporting means where a diameter of the first toner transporting means is substantially constant being B; and a second toner transporting means, disposed between and contacting the image bearing member and the first toner transporting means, a length between the two ends of the second toner transporting means being C, wherein B≈C<A.

8. An image forming apparatus according to claim 7, wherein the image bearing member is a photoconductive drum.

9. An image forming apparatus according to claim 7, wherein the first and second toner transporting means are rollers.

10. An image forming apparatus, comprising:

an image bearing member having a photosensitive layer, the photosensitive layer having a length A;

a first toner transporting means having two ends, a length between the two ends of the first toner transporting means being B; and a second toner transporting means, disposed between and contacting the image bearing member and the first toner transporting means, a length between the two ends of the second toner transporting means being C, wherein A=B=C.

11. An image forming apparatus according to claim 10, wherein the image bearing member is a photoconductive drum.

12. An image forming apparatus according to claim 10, wherein the first and second toner transporting means are rollers.

13. A developing device, comprising:

an image bearing member having a photosensitive layer, the photosensitive layer having a length A;

a first toner transporting roller which is substantially cylindrical and having two ends, a length between the two ends of the first toner transporting roller B; and a second toner transporting roller, which is substantially cylindrical and having two ends, disposed between and contacting the image bearing member and the first toner transporting roller, a length between the two ends of the second toner transporting roller being C, wherein A>C and B>C.

14. A developing device according to claim 13, wherein the image bearing member is a photoconductive drum.

15. A developing device, comprising:

an image bearing member having a photosensitive layer, the photosensitive layer having a length A;

a first toner transporting roller having two tapered ends, a length between the two tapered ends of the first toner transporting roller where a diameter of the first toner transporting roller is substantially constant being B; and a second toner transporting roller, disposed between and contacting the image bearing member and the first toner transporting roller, a length between the two ends of the second toner transporting roller being C, wherein B≈C<A.

16. A developing device according to claim 15, wherein the image bearing member is a photoconductive drum.

17. A developing device, comprising:

an image bearing member having a photosensitive layer, the photosensitive layer having a length A;

a first toner transporting roller having two ends, a length between the two ends of the first toner transporting roller being B; and a second toner transporting roller, disposed between and contacting the image bearing member and the first toner transporting roller, a length between the two ends of the second toner transporting roller being C, wherein A=B=C.

18. A developing device according to claim 17, wherein the image bearing member is a photoconductive drum.

19. A developing device, comprising:

an image bearing member having a photosensitive layer, the photosensitive layer having a length;

a first toner transporting roller which is substantially cylindrical having two ends and a length between the two ends thereof; and a second toner transporting roller which is substantially cylindrical, disposed between and contacting the image bearing member and the first toner transporting roller, having a length between the two ends thereof, wherein the length between the two ends of the second toner transporting roller is less than or equal to the length of the photosensitive layer and the length between the two ends of the second toner transporting roller is less than the length between the two ends of the first toner transporting roller.

* * * * *